US010055924B2

(12) United States Patent
Hemmi et al.

(10) Patent No.: US 10,055,924 B2
(45) Date of Patent: Aug. 21, 2018

(54) BILL PROCESSING DEVICE

(71) Applicant: FUJI ELECTRIC CO., LTD., Kawasaki-shi, Kanagawa (JP)

(72) Inventors: Toshinori Hemmi, Yokkaichi (JP); Toshinori Shigeyama, Mie (JP); Masao Nakayama, Yokkaichi (JP); Masayuki Higashi, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/694,081

(22) Filed: Sep. 1, 2017

(65) Prior Publication Data

US 2018/0082511 A1 Mar. 22, 2018

(30) Foreign Application Priority Data

Sep. 16, 2016 (JP) ..... 2016-181947

(51) Int. Cl.
*G07D 11/00* (2006.01)
*G07D 7/00* (2016.01)

(52) U.S. Cl.
CPC ..... *G07D 11/0087* (2013.01); *G07D 7/00* (2013.01); *G07D 11/0006* (2013.01); *G07D 11/0018* (2013.01); *G07D 11/0033* (2013.01); *G07D 11/0048* (2013.01); *G07D 11/0054* (2013.01); *G07D 2207/00* (2013.01); *G07D 2211/00* (2013.01)

(58) Field of Classification Search
CPC ..... G07D 11/0054; G07D 11/0087; G07D 11/0084
See application file for complete search history.

(56) References Cited

U.S. PATENT DOCUMENTS 6,014,649 A * 1/2000 Kobayashi ..... G06Q 20/108 705/42
6,213,341 B1 * 4/2001 Keith, III ..... G07D 1/00 221/131
6,934,688 B2 * 8/2005 Carter ..... G06Q 10/06398 235/382
9,141,876 B1 * 9/2015 Jones ..... G06K 9/60
2005/0156033 A1 * 7/2005 Van Rens ..... G06Q 20/20 235/385

FOREIGN PATENT DOCUMENTS

JP 2011-065417 A 3/2011

* cited by examiner

*Primary Examiner* — Howard J Sanders
(74) *Attorney, Agent, or Firm* — Manabu Kanesaka

(57) ABSTRACT

A bill processing device includes: a device main body including a depositing portion; a plurality of storage boxes where each has an outlet port; a dispensing box including a bill output port; an outlet door configured to open and close the outlet port of each of the storage boxes; a plurality of outlet port detectors where each is configured to detect the outlet port being opened by the outlet door; and a controller configured to determine that cash balance is unknown only when at least one of the outlet port detectors detects that the outlet port is opened.

4 Claims, 7 Drawing Sheets

BILL PROCESSING DEVICE

CROSS-REFERENCE TO RELATED APPLICATION(S)

The present application claims priority to and incorporates by reference the entire contents of Japanese Patent Application No. 2016-181947 filed in Japan on Sep. 16, 2016.

BACKGROUND

1. Technical Field

The disclosure relates to a bill processing device, and more particularly, relates to a bill processing device that is applied as a bill changing machine, for example.

2. Related Art

Conventionally, in a bill processing device that is applied as a bill changing machine, for example, bills being fed through a depositing portion that is formed on a device main body are conveyed to a predetermined conveyance path, and the authenticity of the bills being conveyed through the conveyance path is discriminated by a discriminating unit.

In the bill processing device, the bills that are discriminated as "true" by the discriminating unit described above are separated from the conveyance path, and are stored in a predetermined storage box. Moreover, in the bill processing device, when a depositing instruction is given, the bills that are sent from the predetermined storage box are discharged from the device main body, by conveying the bills to a dispensing box through the conveyance path described above (for example, see Japanese Patent Application Laid-open No. 2011-65417).

SUMMARY

Although not specified in Japanese Patent Application Laid-open No. 2011-65417 described above, in the bill processing device, the device main body is generally accommodated in a casing. Moreover, an outlet port is formed on each storage box, and when the device main body is removed from the casing, the bills that are stored in each storage box can be taken out through the outlet port.

Hence, in the conventional bill processing device, when the device main body is removed from the casing, regardless of whether the bills are taken out from each storage box, the cash balance is determined to be unknown. When the cash balance is determined to be unknown, an inspection operation is performed after the device main body is accommodated in the casing.

However, when the cash balance is determined to be unknown when the device main body is removed from the casing in this manner, the following problem occurs.

That is, in a configuration in which the bill processing device and a coin processing device are arranged side by side, and the device main body of the bill processing device is removed from the casing upon removing the device main body of the coin processing device from the casing; the device main body of the bill processing device is removed from the casing, when the device main body of the coin processing device is removed from the casing to carry out maintenance work on the coin processing device. If the device main body of the bill processing device is removed from the casing in this manner, the cash balance is determined to be unknown in the bill processing device even if the bills are not taken out from the storage box. As a result, the inspection operation is then performed unnecessarily.

It is an object of the disclosure to at least partially solve the problems in the conventional technology.

In some embodiments, a bill processing device includes: a device main body including a depositing portion; a plurality of storage boxes where each has an outlet port, the storage boxes being configured to, when a bill is fed into the depositing portion, store a bill having a predetermined condition in a storage box corresponding to the bill having the predetermined condition among the storage boxes; a dispensing box including a bill output port, the dispensing box being configured to discharge a bill, which is conveyed from a corresponding storage box to the dispensing box when a dispensing instruction is given, through the bill output port; an outlet door configured to open and close the outlet port of each of the storage boxes; a plurality of outlet port detectors where each is configured to detect the outlet port being opened by the outlet door; and a controller configured to determine that cash balance is unknown only when at least one of the outlet port detectors detects that the outlet port is opened.

The above and other objects, features, advantages and technical and industrial significance of this disclosure will be better understood by reading the following detailed description of presently preferred embodiments of the disclosure, when considered in connection with the accompanying drawings.

BRIEF DESCRIPTION OF THE DRAWINGS

FIG. 7 is a flowchart illustrating processing contents of cash balance determination control performed by a controller illustrated in FIG. 1 and the like.

DETAILED DESCRIPTION

A preferred embodiment of a bill processing device according to the disclosure will now be described in detail with reference to the accompanying drawings.

Figure 1:
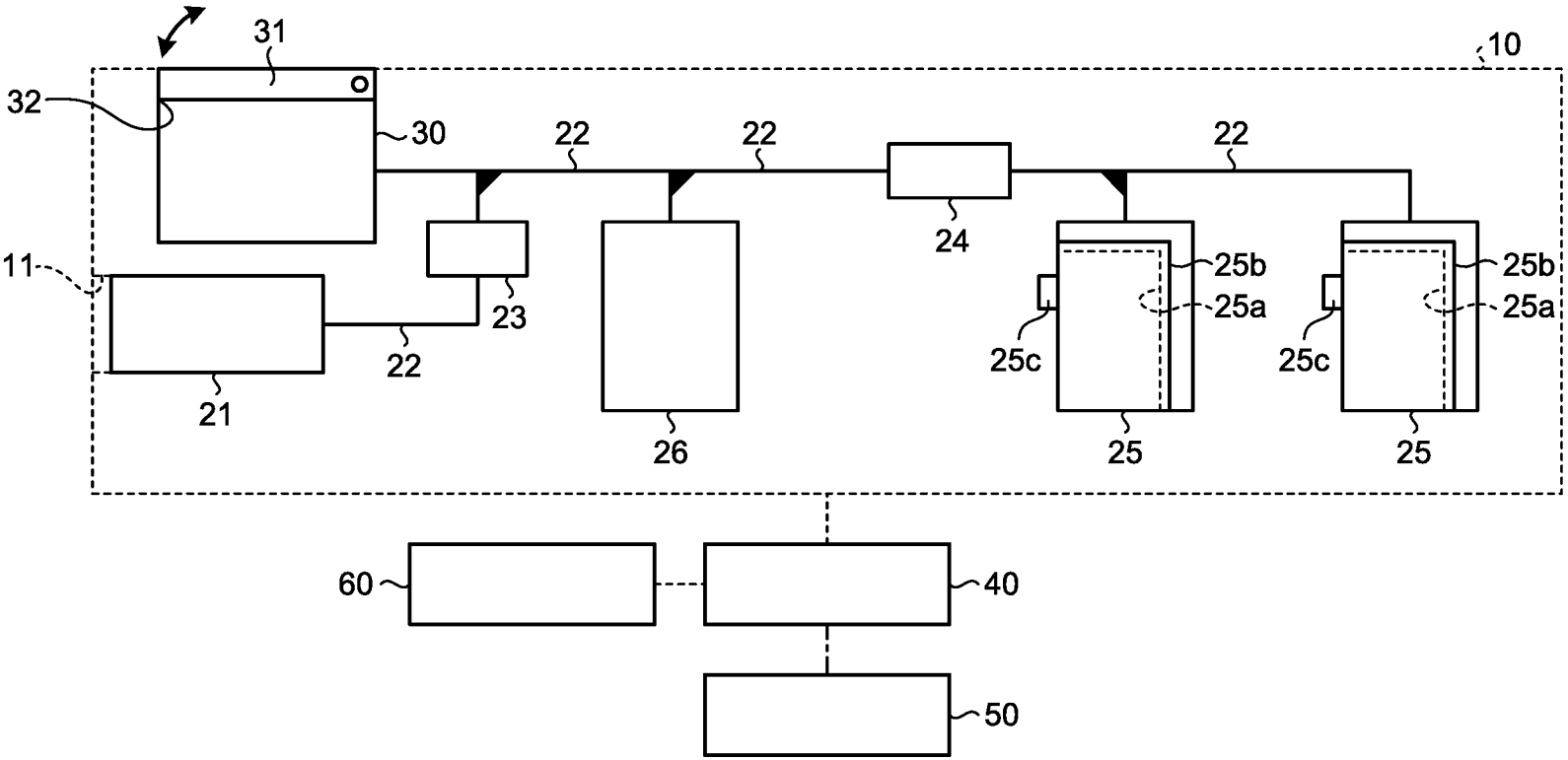
FIG. 1 is an explanatory diagram schematically illustrating a bill processing device of an embodiment of the disclosure.

FIG. 1 is an explanatory diagram schematically illustrating a bill processing device of an embodiment of the disclosure. The bill processing device illustrated in this example is applicable as a bill changing machine, for example, and includes a device main body 10.

The device main body 10 includes a depositing portion 21, a conveyance path 22, a discriminating unit 23, a determining unit 24, a storage box 25, an inspection box 26, and a dispensing and collecting box 30.

The depositing portion 21 is communicably connected to a bill input port 11 formed on the device main body 10. In this example, the bill input port 11 is an opening that is opened and closed by a bill input door, which is not illustrated. The depositing portion 21 delivers bills being fed therein through the bill input port 11, to the conveyance path 22.

The conveyance path 22 extends in the front-to-rear direction inside the device main body 10. Although not illustrated, the conveyance path 22 includes a conveyance unit such as a pair of left and right conveyance belts being stretched over a plurality of conveyance pulleys. The conveyance path 22 is a path that conveys the bills from the front toward the rear, and also conveys the bills from the rear toward the front.

The discriminating unit 23 is placed in the middle of the conveyance path 22. This discriminating unit 23 is a conventionally known discriminating unit, and discriminates the authenticity and denomination of the bills that are delivered from the depositing portion 21 to the conveyance path 22. The discrimination result by the discriminating unit 23 is given to a controller 40 as a discrimination signal.

In this example, the controller 40 integrally controls the operation of the bill processing device based on a computer program and data stored in memory, which is not illustrated. For example, the controller 40 may be implemented by causing a processing device such as a central processing unit (CPU) to execute the computer program, in other words, by software, may be implemented by hardware such as an integrated circuit (IC), or may be implemented by a combination of software and hardware. In the illustrated examples, the controller 40 is illustrated as being provided outside the device main body 10. However, this is only for the sake of convenience, and in reality, the controller 40 is provided inside the device main body 10.

The controller 40 such as the above can communicate with a host device 50 such as a point-of-sale (POS) register device, and can also transmit and receive a signal with a separation sensor 60. In this example, the separation sensor 60 is provided in a casing, which is not illustrated, into which the device main body 10 is to be accommodated. The separation sensor 60 sends an ON signal to the controller 40, when the device main body 10 is removed from the casing.

The determining unit 24 is placed in the middle of the conveyance path 22 at the rear side of the discriminating unit 23. The determining unit 24 is a conventionally known determining unit, and determines the denomination and number of bills that pass therethrough. The determination result by the determining unit 24 is given to the controller 40 as a determination signal.

A plurality of the storage boxes 25 are provided at the rear side of the determining unit 24. Each of the storage boxes 25 stores therein the bills of the designated denomination, based on the discrimination result of the discriminating unit 23. The storage box 25 also delivers the stored bills to the conveyance path 22, based on an instruction from the controller 40.

An outlet port 25*a* is provided on each of the storage boxes 25. The outlet port 25*a* is an opening provided at the side of the storage box 25, and is opened and closed by an outlet door 25*b*. When the outlet port 25*a* is opened, the bills stored in the storage box 25 can be taken out.

Furthermore, each of the storage boxes 25 is provided with a detection sensor 25*c*. The detection sensor 25*c* is an outlet port detector that detects the corresponding outlet port 25*a* being opened. When the opening of the outlet port 25*a* is detected, the detection sensor 25*c* sends an open signal to the controller 40.

The inspection box 26 is provided in front of the determining unit 24. The inspection box 26 stores therein bills when an inspection operation, which will be described below, is performed. The inspection box 26 also delivers the stored bills to the conveyance path 22.

The dispensing and collecting box 30 is detachably provided at the front side of the device main body 10 and above the depositing portion 21. The dispensing and collecting box 30 has a bill output port 32 that is opened and closed by a bill output door 31. In other words, the dispensing and collecting box 30 is provided so that the bill output door 31 is exposed to the outside of the device main body 10. When the bill output door 31 swings open, the bill output port 32 is opened, and the inside of the dispensing and collecting box 30 is exposed to the outside of the device main body 10. The dispensing and collecting box 30 such as the above stores therein the bills that are conveyed through the conveyance path 22, and allows the stored bills to be taken out through the bill output port 32.

As described above, the dispensing and collecting box 30 is detachably provided in the device main body 10. However, when the dispensing and collecting box 30 is provided in the device main body 10 as illustrated in FIG. 1, the dispensing and collecting box 30 cannot be removed from the device main body 10, as long as an exclusive input operation, an operation of inserting an ejection key, which is not illustrated, into a predetermined ejection key hole (not illustrated), or the like is carried out. In other words, the dispensing and collecting box 30 cannot be easily removed from the device main body 10.

When the dispensing and collecting box 30 is provided in the device main body 10, the bill output door 31 swings open and close by an instruction from the controller 40. On the other hand, when the dispensing and collecting box 30 is removed from the device main body 10, the bill output door 31 always closes the bill output port 32. The state of the bill output port 32 being closed is released and the bill output door 31 can swing open, when an operation of inserting a releasing key, which is not illustrated, into a predetermined releasing key hole (not illustrated), or the like is carried out.

An operation of the bill processing device having the configuration described above will now be described. First, a depositing operation will be described.

Figure 2:
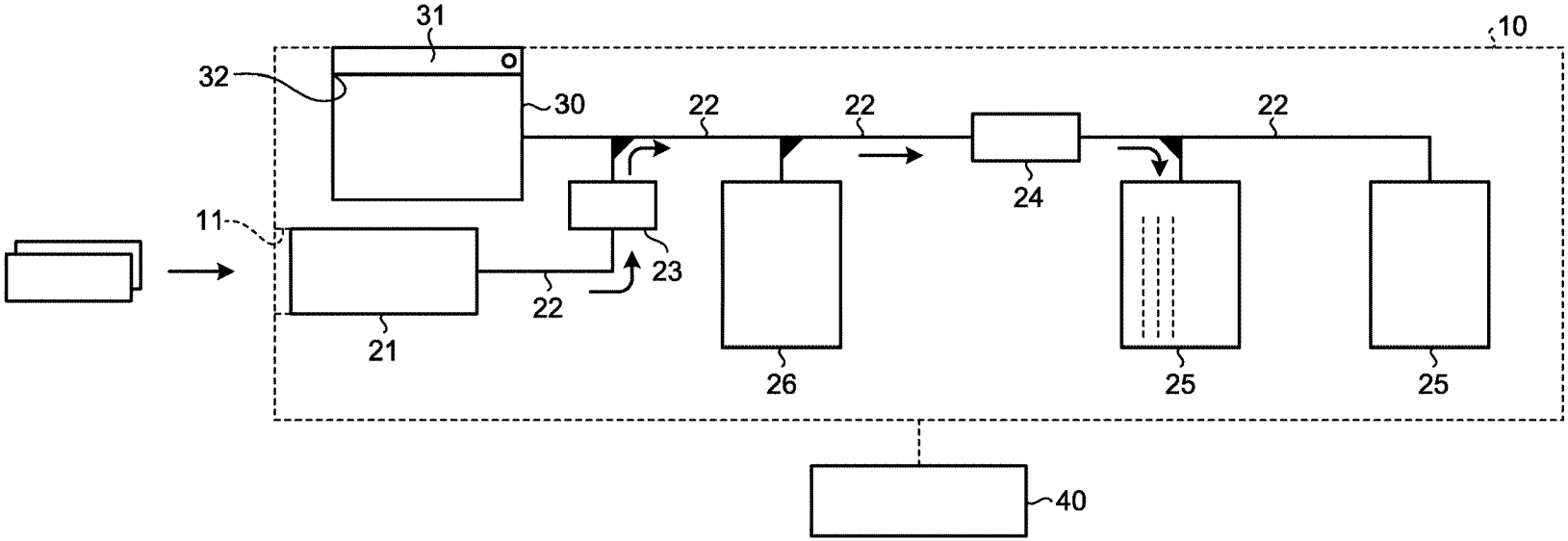
FIG. 2 is an explanatory diagram explaining a case when the bill processing device illustrated in FIG. 1 performs a depositing operation.

When bills are fed into the depositing portion 21 through the bill input port 11, and a user performs an input operation on an input unit, which is not illustrated, to give a depositing instruction, as illustrated in FIG. 2, the bill processing device drives the conveyance unit such as the conveyance pulley under the controller 40, and causes the conveyance unit to deliver the bills, which are fed into the depositing portion 21, to the conveyance path 22 for conveyance. The bill processing device that has conveyed the bills through the conveyance path 22 causes the discriminating unit 23 to discriminate the authenticity and denomination of the bills being conveyed, in the course of conveyance.

When the discriminating unit 23 discriminates that the bills are "true" and discriminates the denomination of the bills, the bill processing device conveys the discriminated bills to the predetermined storage box 25 that is designated for each denomination through the conveyance path 22 and stores the bills in the storage box 25.

Figure 3:
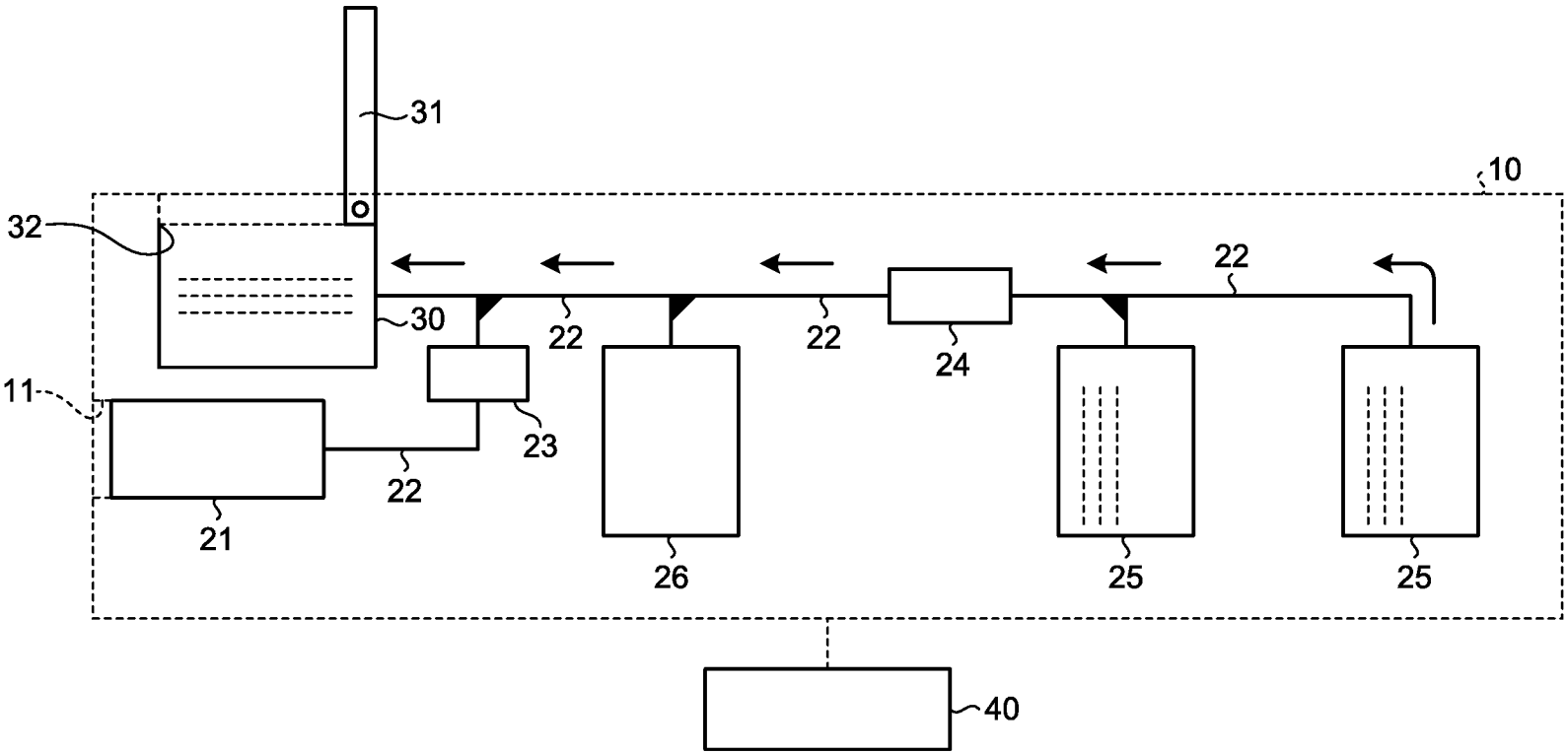
FIG. 3 is an explanatory diagram explaining a case when the bill processing device illustrated in FIG. 1 performs a dispensing operation.

Next, a dispensing operation will be described. When a user performs an input operation on the input unit to give a depositing instruction, as illustrated in FIG. 3, the bill processing device drives the conveyance unit under the controller 40, and causes the conveyance unit to deliver the bills, which are stored in the predetermined storage box 25, to the conveyance path 22 for conveyance. The bill processing device that has conveyed the bills through the conveyance path 22 causes the determining unit 24 to determine the denomination and number of the bills being conveyed, in the course of conveyance.

After the denomination or the like is determined by the determining unit 24, the bill processing device conveys the determined bills to the dispensing and collecting box 30 through the conveyance path 22, and stores the bills in the dispensing and collecting box 30. When a dispensing preparation is completed by storing a predetermined number of bills in the dispensing and collecting box 30 in this manner, the bill processing device causes the bill output door 31 to swing to open the bill output port 32 under the controller 40 and thereby to put the bills stored in the dispensing and collecting box 30 into a state in which the bills can be taken out. The bill processing device then discharges the bills.

Figure 4:
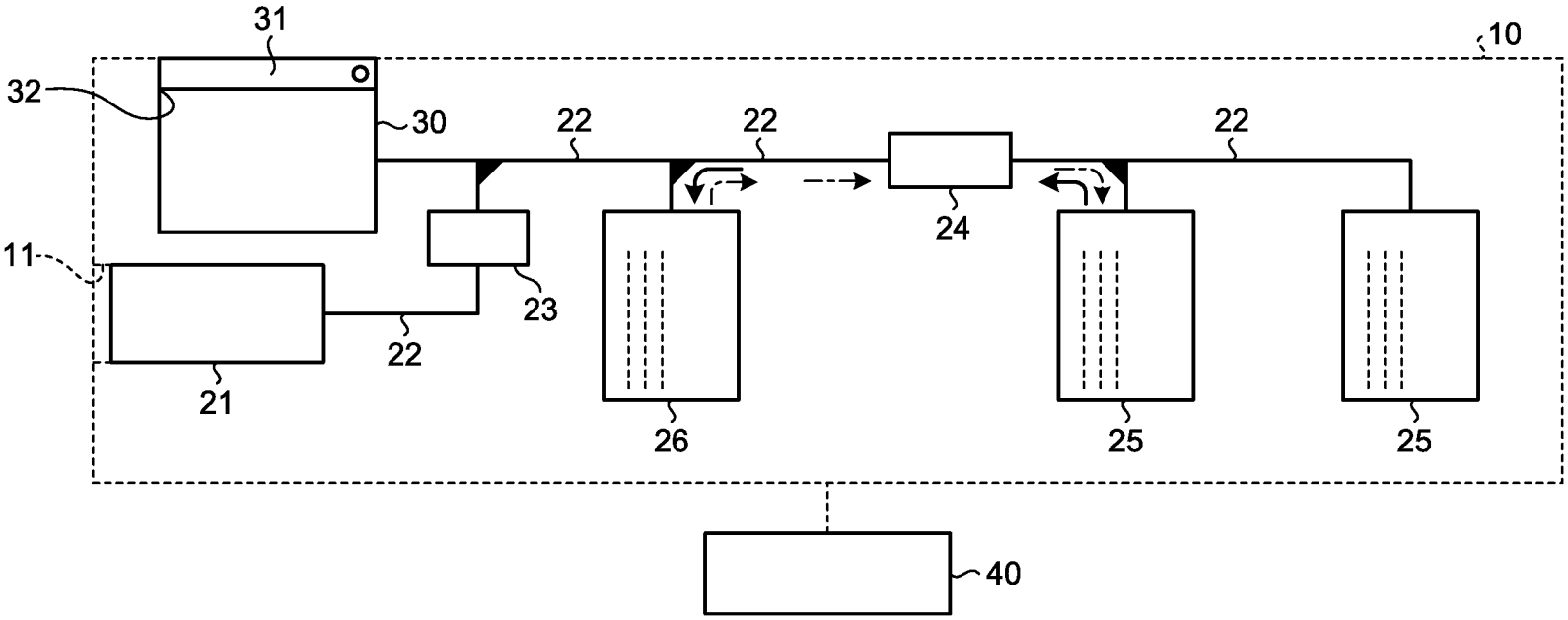
FIG. 4 is an explanatory diagram explaining a case when the bill processing device illustrated in FIG. 1 performs an inspection operation.

An inspection operation will now be described. When a manager or the like performs an input operation on an input unit for the manager (not illustrated) to give an inspection instruction, as illustrated in FIG. 4, the bill processing device drives the conveyance unit under the controller 40, and causes the conveyance unit to deliver the bills, which are stored in the predetermined storage box 25, to the conveyance path 22. The bill processing device also causes the determining unit 24 to determine the denomination and number of the bills being conveyed, in the course of conveyance. The bill processing device then stores the determined bills in the inspection box 26.

After the bills of a predetermined denomination are stored in the inspection box 26 in this manner, the bill processing device drives the conveyance unit under the controller 40, and causes the conveyance unit to deliver the bills from the inspection box 26 to the conveyance path 22, convey the bills toward the rear, and store the bills in the original storage box 25. In this manner, the number of the bills that are stored in the storage box 25 can be counted and checked.

Figure 5:
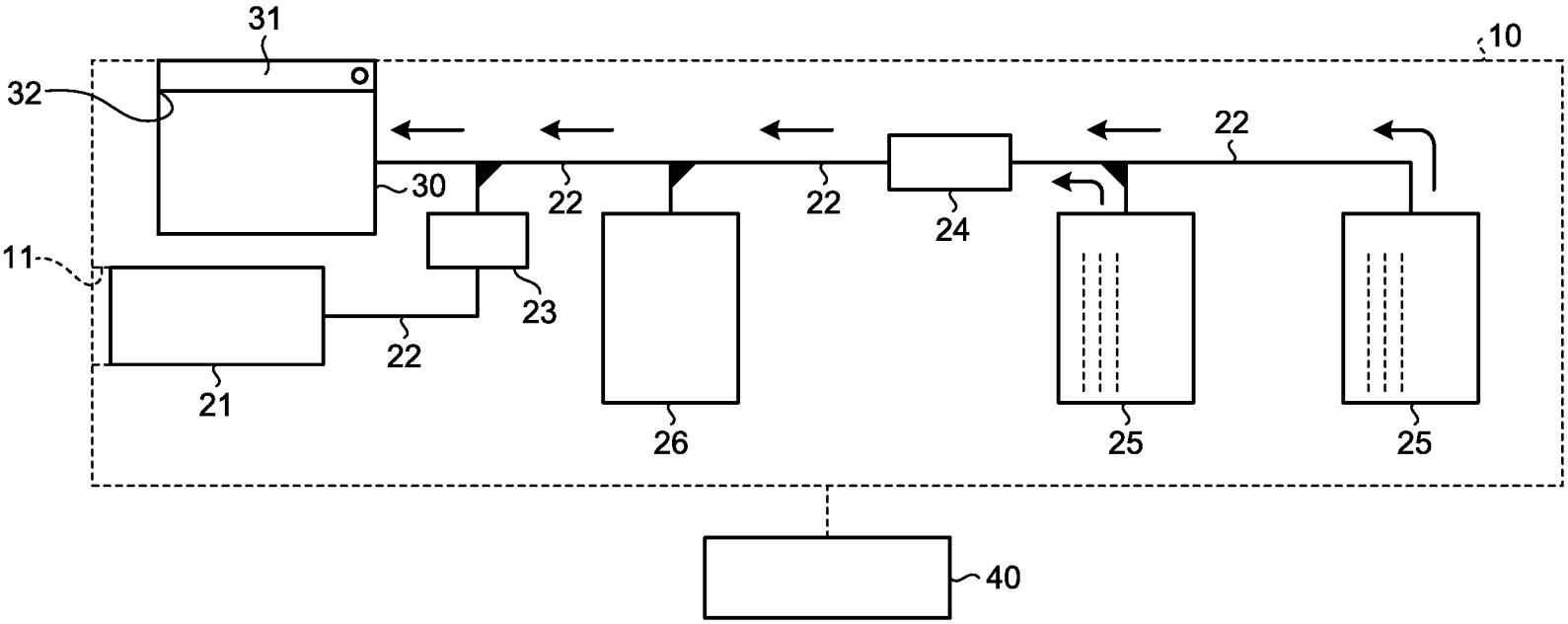
FIG. 5 is an explanatory diagram explaining a case when the bill processing device illustrated in FIG. 1 performs a collecting operation.

Next, a collecting operation will be described. When the manager or the like performs an input operation on the input unit for the manager to give a collecting instruction, as illustrated in FIG. 5, the bill processing device drives the conveyance unit under the controller 40, and causes the conveyance unit to deliver the bills, which are stored in all the storage boxes 25, to the conveyance path 22, convey the bills forward through the conveyance path 22, and store the bills in the dispensing and collecting box 30. In the dispensing and collecting box 30, the bill output port 32 is always in a closed state by the bill output door 31, based on an instruction from the controller 40, and the closed state can only be released by performing an operation of inserting the releasing key into the releasing key hole.

Figure 6:
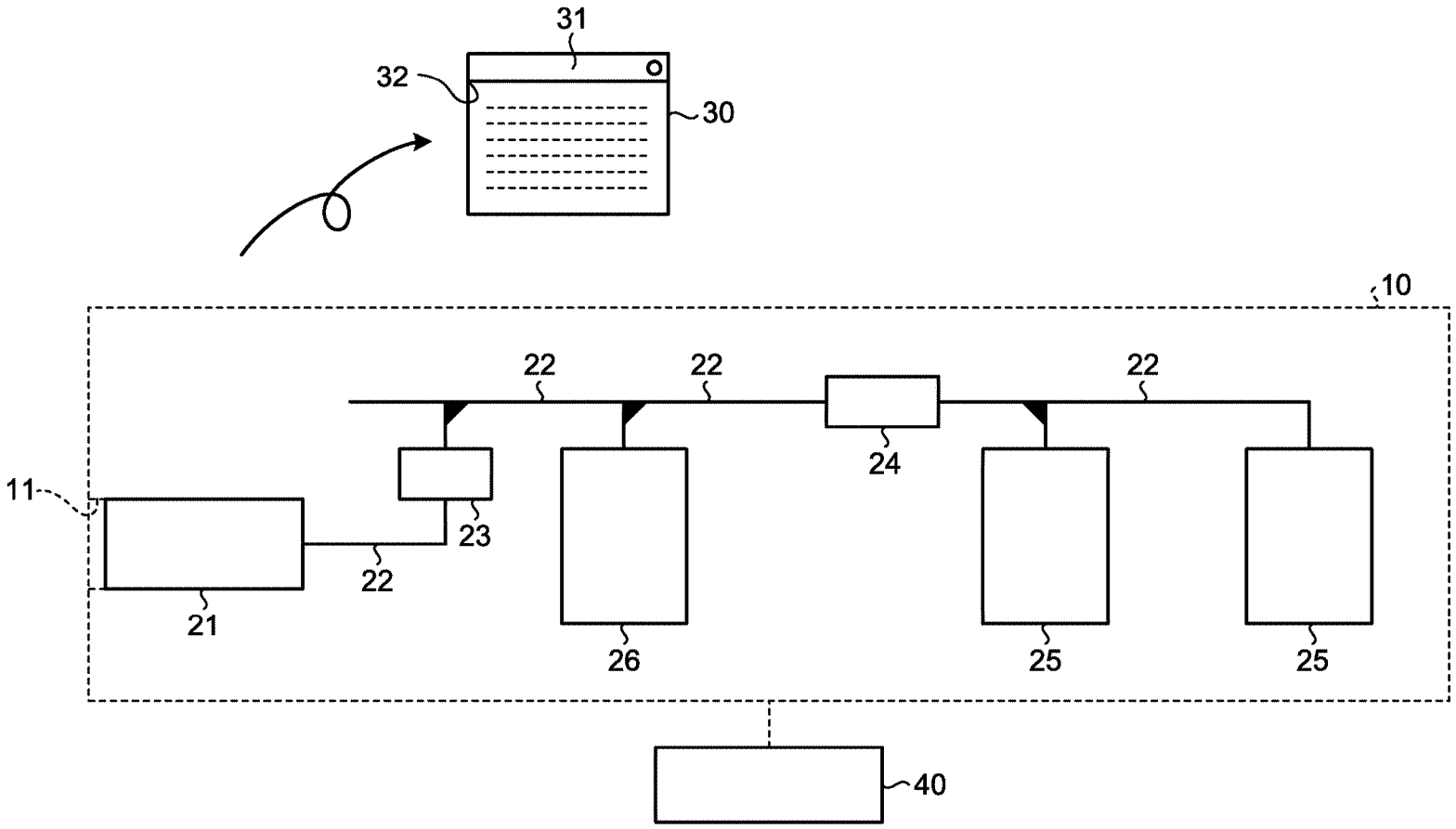
FIG. 6 is an explanatory diagram explaining a case when the bill processing device illustrated in FIG. 1 performs the collecting operation.

In this manner, when the bills in all the storage boxes 25 are stored in the dispensing and collecting box 30, as illustrated in FIG. 6, the bill processing device allows the dispensing and collecting box 30 to be removed from the device main body 10, by performing the operation of inserting the ejection key into the ejection key hole. The dispensing and collecting box 30 that is removed in this manner will be kept in a safe managed by the manager.

In the bill processing device described above, the separation sensor 60 detects the removal of the device main body 10 from the casing. The controller 40 that receives an ON signal from the separation sensor 60 performs cash balance determination control as follows.

Figure 7:
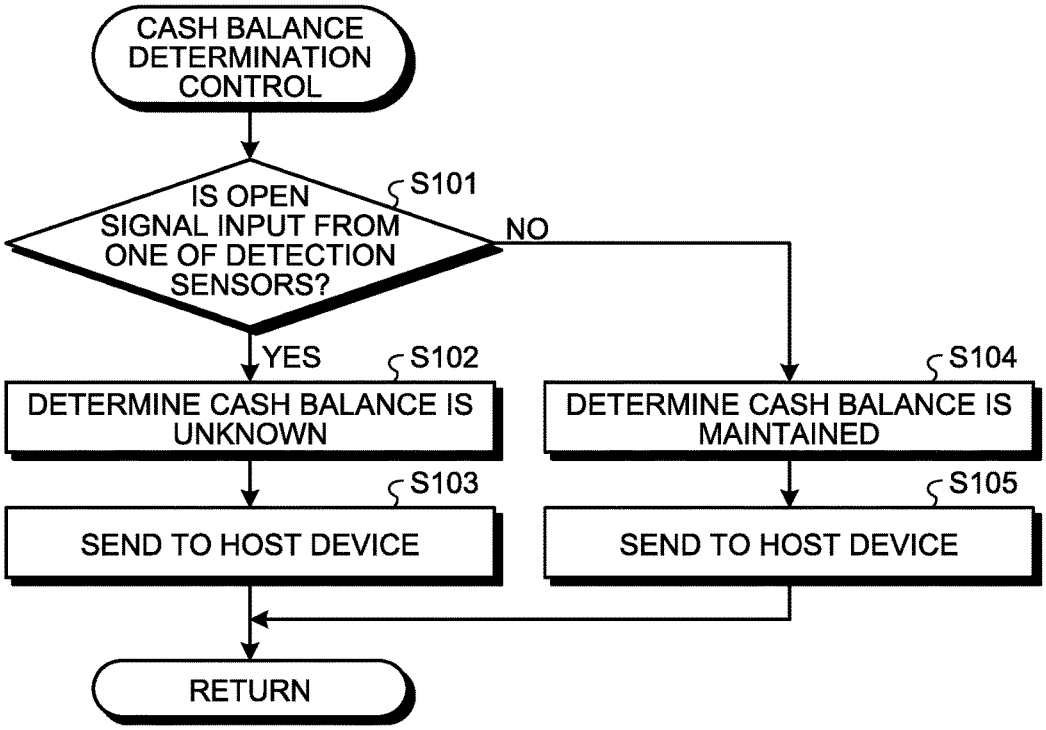

FIG. 7 is a flowchart illustrating processing contents of cash balance determination control performed by the controller 40 illustrated in FIG. 1 and the like.

In the cash balance determination control, upon receiving an open signal from one of the detection sensors 25*c* (Yes at Step S101), the controller 40 determines that the cash balance is unknown (step S102), as there is a possibility that the bills may be extracted from the storage box 25. The controller 40 that has determined the cash balance is unknown in this manner sends a notification that the cash balance has been determined to be unknown, to the host device 50 such as the POS register device (step S103). The controller 40 then performs the procedure again and finishes this process.

In this case, because the cash balance is unknown, the inspection operation is performed after the device main body 10 is accommodated in the casing.

On the other hand, when the controller 40 does not receive an open signal from any of the detection sensors 25*c* (No at step S101), the controller 40 determines that the cash balance is maintained (step S104), as there is no possibility that the bills are extracted from the storage box 25. The controller 40 that has determined the cash balance is maintained in this manner sends a notification that the cash balance has been determined to be maintained, to the host device 50 such as the POS register device (step S105). The controller 40 then performs the procedure again and finishes this process.

In this case, because the cash balance is maintained, it is possible to prevent the inspection operation from being performed after the device main body 10 is accommodated in the casing.

As described above, in the bill processing device of the present embodiment, the controller 40 determines that the cash balance is unknown only when at least one of the detection sensors 25*c* detects the outlet port 25*a* being opened, and does not determine that the cash balance is unknown when the device main body 10 is just removed from the casing. Thus, there is no need to perform the inspection operation every time the device main body is removed from the casing, as in the conventional example. Consequently, it is possible to reduce the number of times of the inspection operation performed on the bills that are stored in the storage boxes 25.

Moreover, when the controller 40 has determined that the cash balance is unknown, the notification that the cash balance has been determined to be unknown is sent to the host device 50. Consequently, the host device 50 can recognize the fact that the cash balance has been determined to be unknown.

In the bill processing device described above, the dispensing and collecting box 30 collects the bills that are stored in the storage boxes 25 when a collecting instruction is given. Thus, the dispensing and collecting box 30 also functions as a conventional collecting box. In this manner, the installation space of the collecting box can be reduced, thereby reducing the overall size of the device.

In the bill processing device described above, the dispensing and collecting box 30 is detachably provided at the device main body 10. Thus, the dispensing and collecting box 30 can be kept in a predetermined safe and the like as a whole, by removing the dispensing and collecting box 30 from the device main body 10, after the bills that are stored in the storage boxes 25 are stored in the dispensing and collecting box 30. Consequently, there is no need to take out the bills from the dispensing and collecting box 30, thereby improving the security.

The preferred embodiment of the disclosure has been described above. However, the disclosure is not limited to the embodiment, and various modifications may be made.

In the embodiment described above, in the collecting operation, the bill output door 31 always closes the bill output port 32. However, in the disclosure, the bill output port 32 may also be opened and closed by the bill output door 31 based on an instruction from the controller 40, in the collecting operation.

In the embodiment described above, the outlet port 25*a* is provided at the side of the storage box 25. However, in the disclosure, the outlet port can adopt various forms as long as the bills stored in the storage box can be taken out. In other words, while the conveyance path includes a base and a cover, and when the conveyance path is opened upon the cover being swung upward, for example, the opening facing the conveyance path of the storage box may be served as the outlet port. In this case, the cover forms the outlet door, and the outlet port is opened upon the cover being swung.

In the disclosure, the controller determines that the cash balance is unknown only when the outlet port detector detects that at least one of the outlet ports provided on each of the storage boxes is opened, and does not determine that the cash balance is unknown when the device main body is just removed from the casing that accommodates the device main body. Thus, there is no need to perform the inspection operation every time the device main body is removed from the casing as in the conventional example, and it is possible to advantageously reduce the number of times of the inspection operation performed on the bills that are stored in the storage boxes.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A bill processing device comprising:

a device main body including a depositing portion;

a plurality of storage boxes where each has an outlet port, the storage boxes being configured to, when a bill is fed into the depositing portion, store a bill having a predetermined condition in a storage box corresponding to the bill having the predetermined condition among the storage boxes;

a dispensing box including a bill output port, the dispensing box being configured to discharge a bill, which is conveyed from a corresponding storage box to the dispensing box when a dispensing instruction is given, through the bill output port;

an outlet door configured to open and close the outlet port of each of the storage boxes;

a plurality of outlet port detectors where each is configured to detect the outlet port being opened by the outlet door; and a controller configured to determine that cash balance is unknown only when at least one of the outlet port detectors detects that the outlet port is opened.

2. The bill processing device according to claim 1, wherein the controller is configured to send a notification that the cash balance has been determined to be unknown, to a host device when the cash balance has been determined to be unknown.

3. The bill processing device according to claim 1, wherein the dispensing box is detachably provided at the device main body, and is configured to collect the bill stored in each of the storage boxes when a collecting instruction is given.

4. The bill processing device according to claim 2, wherein the dispensing box is detachably provided at the device main body, and is configured to collect the bill stored in each of the storage boxes when a collecting instruction is given.

* * * * *